US008092178B2

(12) United States Patent
Marini et al.

(10) Patent No.: US 8,092,178 B2
(45) Date of Patent: Jan. 10, 2012

(54) TURBINE BLADE FOR A GAS TURBINE ENGINE

(75) Inventors: Remo Marini, Montreal (CA); Sami Girgis, Montréal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 538 days.

(21) Appl. No.: 12/324,998

(22) Filed: Nov. 28, 2008

(65) Prior Publication Data

US 2010/0135813 A1 Jun. 3, 2010

(51) Int. Cl.
*F01D 5/08* (2006.01)

(52) U.S. Cl. ..... 416/97 R; 416/96 R

(58) Field of Classification Search ..... 416/97 R, 416/228, 235, 236 R, 238, 96 R
See application file for complete search history.

(56) References Cited

U.S. PATENT DOCUMENTS

| | | | | |
|---|---|---|---|---|
| 1,828,409 | A | | 10/1931 | Densmore |
| 4,540,339 | A | | 9/1985 | Horvath |
| 4,874,290 | A | | 10/1989 | Cang et al. |
| 4,875,831 | A | | 10/1989 | Fetiveau |
| 4,893,987 | A | | 1/1990 | Lee et al. |
| 4,957,411 | A | | 9/1990 | Girault |
| 5,183,385 | A | | 2/1993 | Lee et al. |
| 5,261,789 | A | | 11/1993 | Butts et al. |
| 5,282,721 | A | * | 2/1994 | Kildea ..... 416/97 R |
| 5,348,446 | A | | 9/1994 | Lee et al. |
| 5,458,461 | A | | 10/1995 | Lee et al. |
| 5,476,363 | A | | 12/1995 | Freling et al. |
| 5,564,902 | A | | 10/1996 | Tomita |
| 5,660,523 | A | | 8/1997 | Lee |
| 5,733,102 | A | | 3/1998 | Lee et al. |
| 5,738,491 | A | | 4/1998 | Lee et al. |
| 5,822,852 | A | | 10/1998 | Bewlay et al. |
| 5,997,251 | A | | 12/1999 | Lee |
| 6,027,306 | A | | 2/2000 | Bunker |
| 6,039,531 | A | | 3/2000 | Suenaga et al. |
| 6,059,530 | A | | 5/2000 | Lee |
| 6,086,328 | A | | 7/2000 | Lee |
| 6,135,715 | A | | 10/2000 | Correia |
| 6,164,914 | A | | 12/2000 | Correia et al. |
| 6,176,678 | B1 | | 1/2001 | Brainch et al. |
| 6,179,556 | B1 | | 1/2001 | Bunker |
| 6,183,199 | B1 | | 2/2001 | Beeck et al. |
| 6,190,129 | B1 | | 2/2001 | Mayer et al. |
| 6,224,336 | B1 | | 5/2001 | Kercher |
| 6,224,337 | B1 | | 5/2001 | Lieland et al. |
| 6,231,307 | B1 | | 5/2001 | Correia |
| 6,332,272 | B1 | | 12/2001 | Sinnott et al. |
| 6,333,121 | B1 | | 12/2001 | Walston et al. |

(Continued)

FOREIGN PATENT DOCUMENTS

| | | |
|---|---|---|
| DE | 560589 | 10/1932 |

(Continued)

*Primary Examiner* — Kiesha Bryant
*Assistant Examiner* — Mark Tornow
(74) *Attorney, Agent, or Firm* — Norton Rose OR LLP

(57) ABSTRACT

The turbine blade comprises an airfoil having opposite pressure and suction sidewalls extending from a platform to a free end tip and in a chordwise direction from a leading edge to a trailing edge. The blade has two winglets extending in a chordwise direction from adjacent the leading edge to adjacent the trailing edge. Each winglet extends from the pressure sidewall upwardly and outwardly from the sidewall to provide a channel between them. Each winglet has a free end extending laterally beyond a surface defined by the pressure sidewall offset.

10 Claims, 4 Drawing Sheets

U.S. PATENT DOCUMENTS

| | | | | |
|---|---|---|---|---|
| 6,382,913 | B1 | 5/2002 | Lee et al. | |
| 6,422,821 | B1 | 7/2002 | Lee et al. | |
| 6,468,040 | B1 | 10/2002 | Grylls et al. | |
| 6,494,678 | B1 * | 12/2002 | Bunker | 416/97 R |
| 6,672,829 | B1 | 1/2004 | Cherry et al. | |
| 6,790,005 | B2 | 9/2004 | Lee et al. | |
| 6,991,430 | B2 | 1/2006 | Stec et al. | |
| 7,029,235 | B2 | 4/2006 | Liang | |
| 7,118,342 | B2 | 10/2006 | Lee et al. | |
| 7,281,894 | B2 * | 10/2007 | Lee et al. | 416/92 |
| 7,351,035 | B2 * | 4/2008 | Deschamps et al. | 416/92 |
| 2002/0136638 | A1 | 9/2002 | Junkin | |
| 2002/0141868 | A1 | 10/2002 | Lee et al. | |
| 2002/0141869 | A1 | 10/2002 | Lee et al. | |
| 2002/0187044 | A1 | 12/2002 | Lee et al. | |
| 2002/0197159 | A1 | 12/2002 | Roeloffs | |
| 2002/0197160 | A1 | 12/2002 | Liang | |
| 2003/0021684 | A1 | 1/2003 | Downs et al. | |
| 2003/0082054 | A1 | 5/2003 | Grylls et al. | |
| 2003/0118444 | A1 | 6/2003 | Lee et al. | |
| 2004/0096328 | A1 | 5/2004 | Soechting et al. | |
| 2004/0109754 | A1 | 6/2004 | Townes et al. | |
| 2004/0126236 | A1 | 7/2004 | Lee et al. | |
| 2004/0197190 | A1 | 10/2004 | Stec et al. | |
| 2005/0095129 | A1 | 5/2005 | Benjamin et al. | |
| 2005/0244270 | A1 | 11/2005 | Liang | |
| 2005/0281671 | A1 | 12/2005 | Liang | |
| 2006/0051209 | A1 | 3/2006 | Lee et al. | |
| 2006/0062671 | A1 | 3/2006 | Lee et al. | |
| 2006/0067821 | A1 | 3/2006 | Wadia et al. | |
| 2006/0088420 | A1 | 4/2006 | Lee | |
| 2006/0174482 | A1 | 8/2006 | Roedl et al. | |
| 2006/0257257 | A1 | 11/2006 | Deschamps et al. | |
| 2007/0059173 | A1 | 3/2007 | Lee et al. | |
| 2007/0059182 | A1 * | 3/2007 | Stegemiller et al. | 416/223 R |
| 2007/0128033 | A1 | 6/2007 | Lee et al. | |
| 2007/0237637 | A1 | 10/2007 | Lee et al. | |
| 2007/0248750 | A1 | 10/2007 | Allen | |
| 2007/0258815 | A1 | 11/2007 | Liang | |
| 2008/0118367 | A1 | 5/2008 | Liang et al. | |
| 2008/0226460 | A1 | 9/2008 | Ochiai et al. | |
| 2009/0081024 | A1 * | 3/2009 | Tibbott | 415/115 |

FOREIGN PATENT DOCUMENTS

| | | | |
|---|---|---|---|
| DE | 815971 | | 10/1951 |
| EP | 1764477 | A1 | 3/2007 |
| EP | 1764477 | B1 | 7/2008 |
| EP | 1721698 | B1 | 11/2008 |
| GB | 946794 | | 1/1964 |

* cited by examiner

TURBINE BLADE FOR A GAS TURBINE ENGINE

TECHNICAL FIELD

The technical field generally relates to gas turbine engines and, in particular, to turbine blades used in gas turbine engines.

BACKGROUND

In a gas turbine engine, to maximize efficiency the turbine blade tip is positioned as close as possible to the interior of the static shroud surrounding the blade tips. However, although the clearance between the tip of the blades and the surrounding shroud is kept to a minimum, some of the gas on the pressure side tends to leaks over the blade tip to the suction side, thereby resulting in a loss since the leaking gas does not do any work. So called squealer tips attempt to reduce tip leakage because of the tip recess presence and additionally by blowing cooling air in the tip region of the blade, but room for improvement remains. It is thus desirable to further improve turbine blade design.

SUMMARY

In one aspect, the present concept provides a turbine blade comprising an airfoil having opposite pressure and suction sidewalls extending from a platform to a free end tip and in a chordwise direction from a leading edge to a trailing edge. The blade has two winglets extending in a chordwise direction from adjacent the leading edge to adjacent the trailing edge. Each winglet extends from the pressure sidewall upwardly and outwardly from the sidewall to provide a channel between them. Each winglet has a free end extending laterally beyond a surface defined by the pressure sidewall offset.

Further details of these and other aspects will be apparent from the detailed description and figures included below.

DETAILED DESCRIPTION

Figure 1:
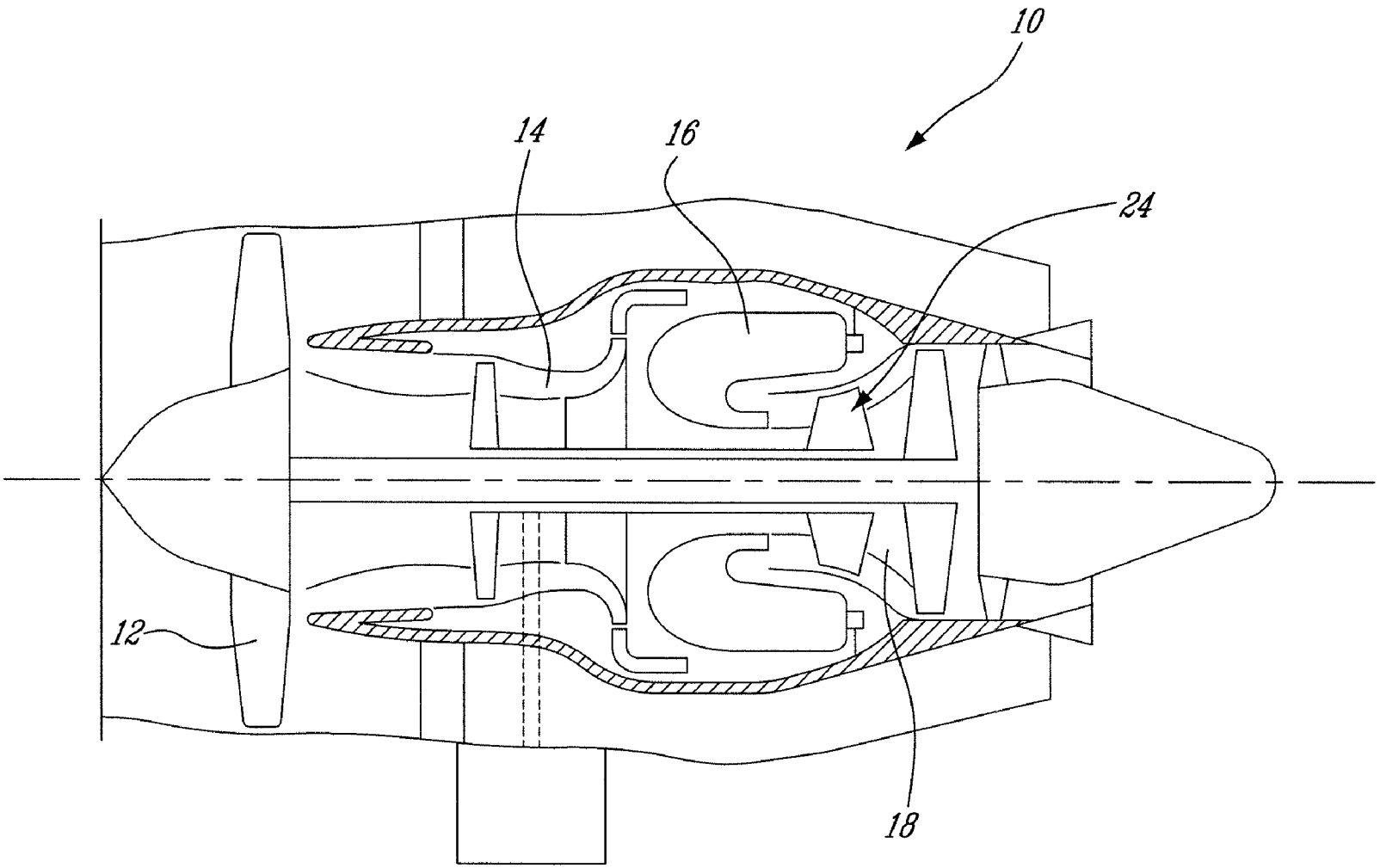
FIG. 1 schematically shows a gas turbine engine incorporating a set of turbine blades.

FIG. 1 illustrates an example of a gas turbine engine 10 of a type provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The turbine section 18 includes a plurality of blades 24.

Figure 2:
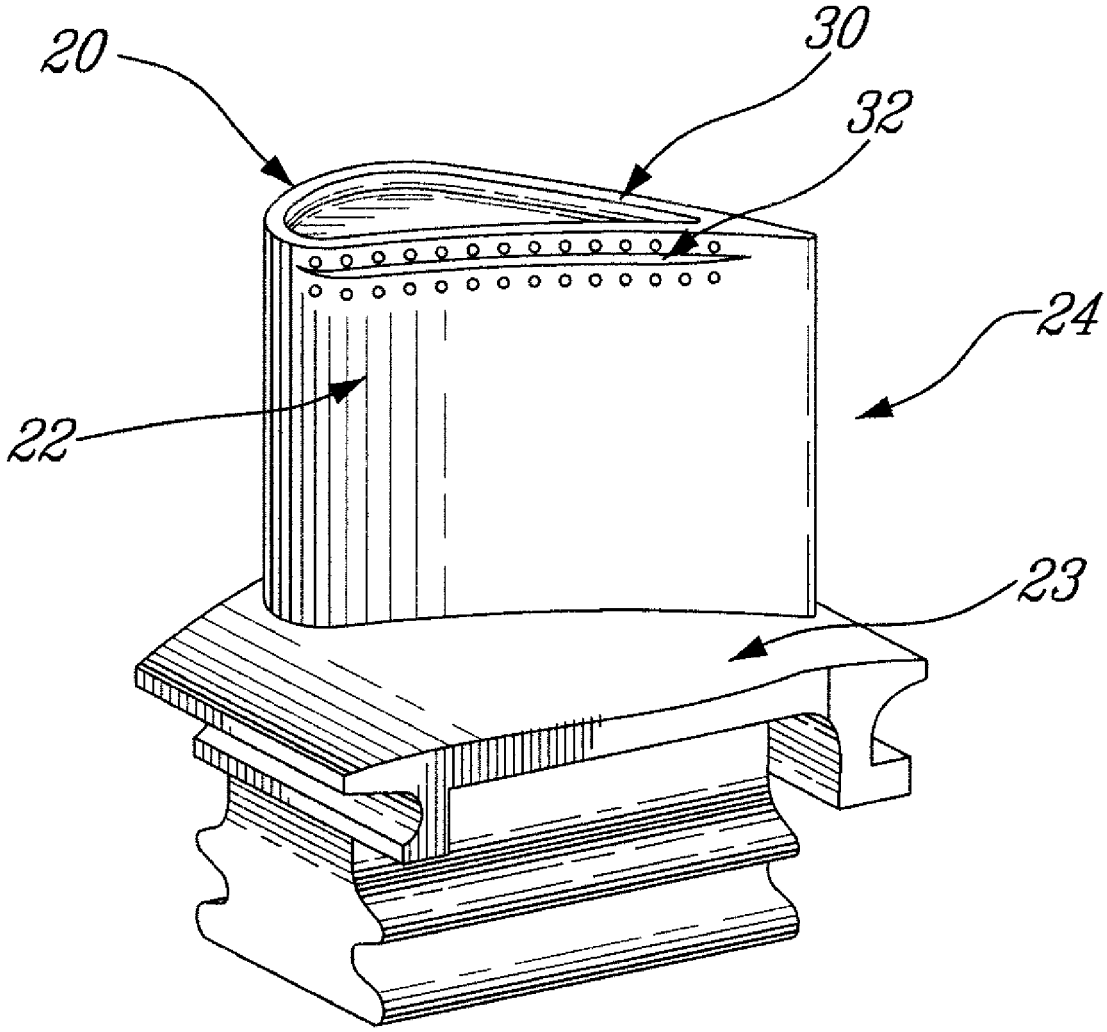
FIG. 2 is an isometric view of an example of an improved turbine blade.
Figure 3:
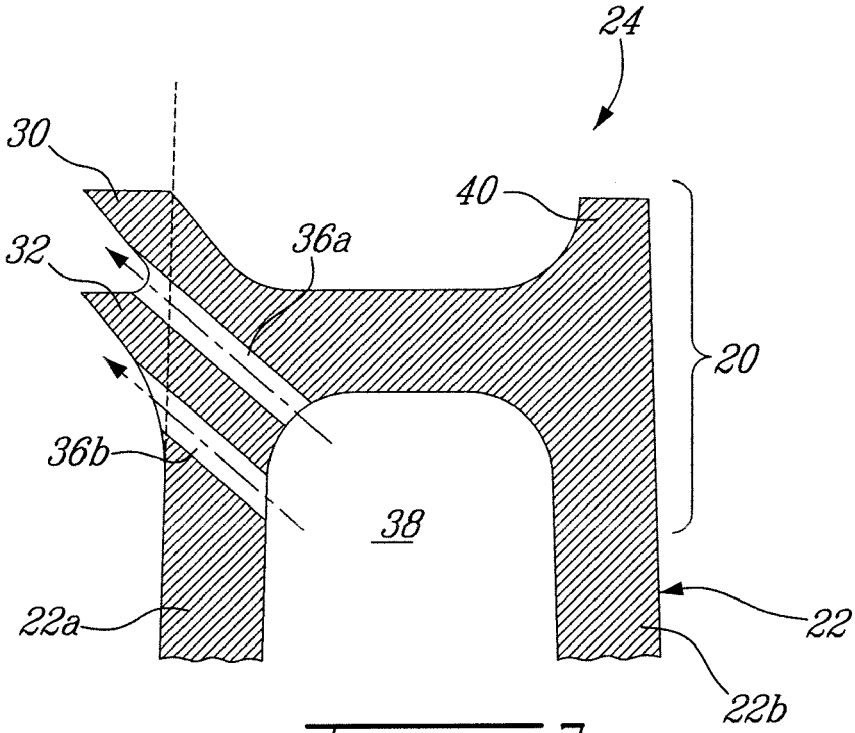
FIG. 3 is a cross-sectional view, viewed along the lines III-III in FIG. 4, of the tip portion of the blade of FIG. 2.

FIG. 2 shows an example of an individual blade 24 as improved. The blade 24 has an airfoil 22, which projects from a platform 23 to a free end or tip 20. The airfoil 22 has opposite pressure and suction sidewalls 22*a*, 22*b*, as shown for example in FIG. 3, extending chordwise between a leading edge and a trailing edge of the blade 24.

The tip 20 of the blade 24 includes two outwardly-and-upwardly-angled and chordwise-extending winglets 30, 32 on the pressure side wall 22*a* adjacent the blade tip. Each winglet 30, 32 is laterally offset from the airfoil 22, such that the tip of each winglet 30, 32 extends away from a "plane" defined by the pressure sidewall 22*a* of the airfoil 22, as shown using the stippled line in FIG. 3, to a terminal point outwardly therefrom. The tip of each winglet 30, 32 need not extend by the same amount from the leading edge to the trailing edge. The lateral or horizontal extent of each winglet 30, 32 may be selected depending on the blade pressure loading distribution, from leading edge to trailing edge, and thus tends to be an optimization for a particular blade design.

Figure 4:
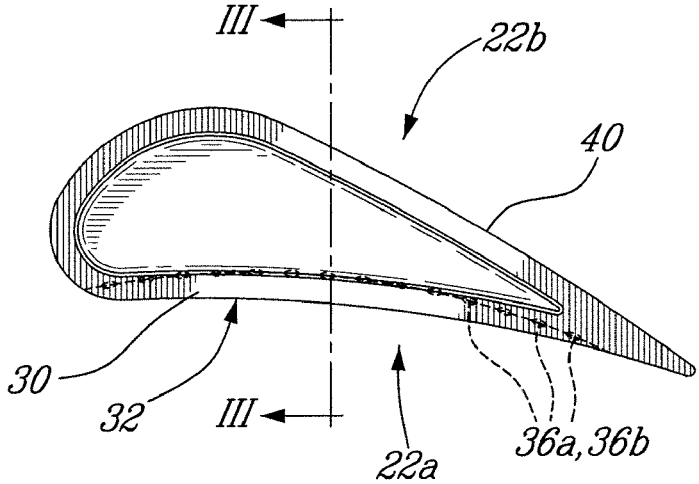
FIG. 4 is an end-on view of the turbine blade of FIG. 2.

The winglets 30, 32 typically extend upwardly and outwardly at between 30 to 60 degrees from a vertical reference line for optimal performance, although any suitable angle may be employed. The winglets 30, 32 need not be parallel but may typically be within about ±15 degrees in parallelism. The winglets 30, 32 typically extend from a point on the pressure sidewall 22*a* adjacent to the leading edge to a point on the pressure sidewall 22*a* adjacent to the trailing edge. Winglet 30 and rib 40 cooperate to form a tip rail around the tip periphery, as shown in FIG. 4.

A row of inclined passageways 36*a* optionally extend from a cooling circuit (in this example generically illustrated as 38) in the interior of the airfoil 22 to an outlet provided between the winglets 30, 32. The row may extend the entire length of the winglet(s), as shown in FIG. 4, or may extend only along a portion thereof. The spacing between adjacent outlets in a row may be regular or not. The presence of outlets may be intermittent along the length of the row, as well. The designer will determine what is suitable for the design, in light of the teachings herein.

Also optionally, a second row of inclined passageways 36*b* may be provided below winglet 32, extending thereto from internal pressurized cooling air circuit(s), in this example generically illustrated as 38, as aforesaid, in the interior of the airfoil 22. The spacing between adjacent outlets in a row may be regular or not. The presence of outlets of the passage ways 36*b* may be intermittent along the length of the row, as well. The designer will determine what is suitable for the design, in light of the teachings herein. The position, length, chordwise extent, etc, of the second row 36*b* need not be the same as the row 36*a*.

The passageways 36*a*, 36*b* typically are angled at about 30 to 60 degrees relative to a vertical reference line, but the angle may tend to be dependant somewhat on the positioning of the air circuit(s) 38 relative to the winglets 30, 32. The passageways 36*a*, 36*b* need not be parallel (amongst or within rows) but will usually be within about ±15 degrees in parallelism with each other and with the winglets 30, 32.

In use, the lower offset winglet 32 tends to isolate the upper offset winglet 30 and form a pocket where the tip leakage flow must negotiate a larger turn before passing over the upper winglet 30. This may lead to a controlled separation region over the radially outer surface of the upper winglet 30 that displaces the air gap and may increase the tip leakage path resistance of the squealer tip 20 configuration (comprised of the upper offset winglet 30 and the rib 40) when compared to conventional pressure surface squealer tip designs, angled or not. Furthermore, where passageways 36*a* and/or 36*b* are provided, pressurised air from the air circuit 38 is channeled to the outlets of the passageways 36*a* and/or 36*b* under the winglets 30, 32, which may increase the leakage resistance for the gas circulating over the squealer tip 20 from the pressure side to the section side. Air exiting the passageways 36*a* and/or 36*b* also provides cooling in the region of the squealer tip 20. The presence of the flow from passageways 36*a* and/or 36*b* also tends to increase the resistance on the tip leakage flow. In addition, the winglets configuration tends to cause air flows injected below the winglet(s) to tend to remain in the region longer than would otherwise be the case, which may lead to improved blade tip cooling.

Figure 5:
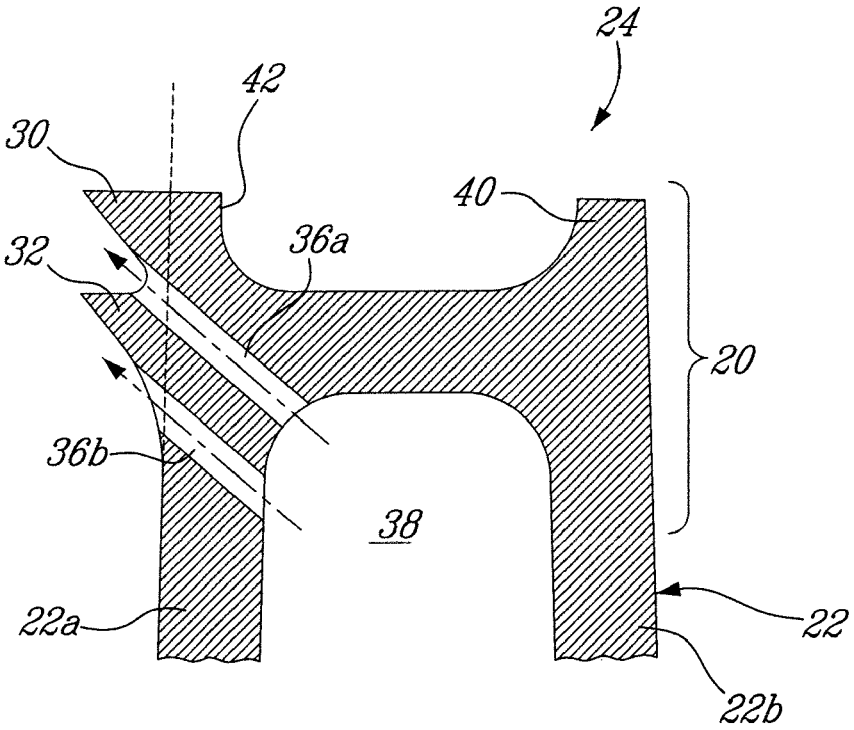
FIG. 5 is a cross-sectional view, similar to FIG. 3, of the tip portion of another example of an improved turbine blade.
Figure 6:
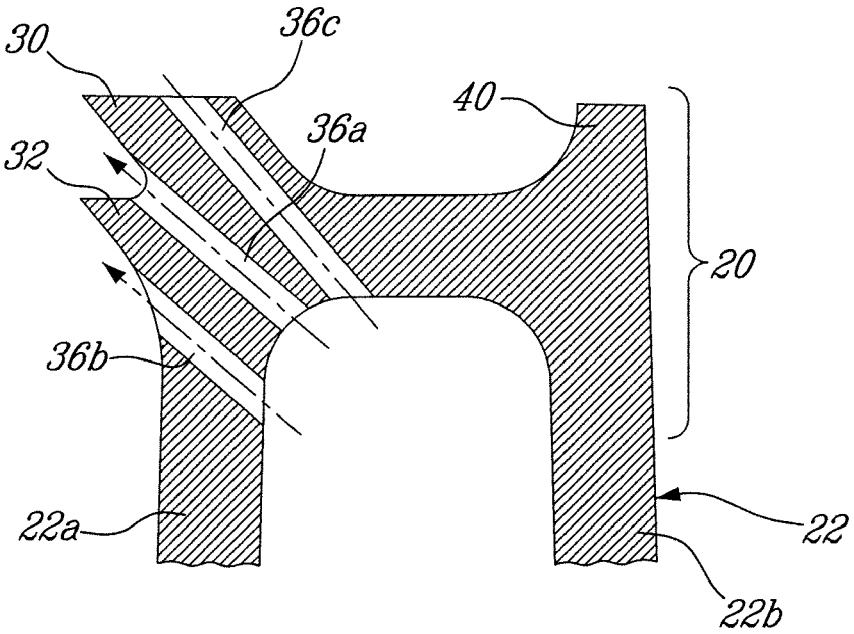
FIG. 6 is a cross-sectional view, similar to FIG. 3, of the tip portion of another example of an improved turbine blade.

The above description is meant to be exemplary only, and one skilled in the art will recognize that changes may be made to the examples described without departing from the scope of what is disclosed herein. For example, the angle of adjacent passageways need not necessarily to be equal and the passageways are not necessarily straight or having the same supply location in the interior of the airfoil. In one other example, shown in FIG. 5, the inner face 42 of the upper winglet 30 may also be substantially vertically extending. In another example, shown in FIG. 6, additional outlet passageways 36*c* may be provided on the tip surface of the upper winglet 30, if sufficient rib thickness is provided. The term "row" is used herein in broad sense and encompasses using staggered or other unaligned sets of passageways. Still other modifications will be apparent to those skilled in the art, in light of a review of this disclosure, and such modifications are intended to fall within the appended claims.

What is claimed is:

1. A turbine blade comprising an airfoil having opposite pressure and suction sidewalls extending from a platform to a free end tip and in a chordwise direction from a leading edge to a trailing edge, the blade having two winglets extending in a chordwise direction from adjacent the leading edge to adjacent the trailing edge, each winglet extending from the pressure sidewall upwardly and outwardly from the sidewall to provide a channel between them, each winglet having a free end extending laterally beyond a surface defined by the pressure sidewall offset, the blade having air passageways extending from an inlet communicating with a pressurized air circuit inside the airfoil to an outlet located in the channel.

2. The blade as defined in claim 1, further comprising additional passageways each extending from an inlet communicating with a pressurized air circuit inside the airfoil to an outlet located below a lower of the two winglets.

3. The blade as defined in claim 1, further comprising additional passageways each extending from an inlet communicating with a pressurized air circuit inside the airfoil to an outlet located in a portion of the blade tip adjacent an upper of the two winglets.

4. The blade as defined in claim 1, further comprising additional passageways, wherein the respective outlet of the additional passageways is located in a portion of the blade tip adjacent an upper of the two winglets.

5. The blade as defined in claim 1, further comprising additional passageways, wherein the respective outlet of some of the additional passageways is located below a lower of the two winglets and the respective outlet of some of the additional passageways is located in a portion of the blade tip adjacent an upper of the two winglets.

6. The blade as defined in claim 1, wherein the passageways are angled at about 30 to 60 degrees relative to a vertical reference line.

7. The blade as defined in claim 5, wherein the passageways are angled at about 30 to 60 degrees relative to a vertical reference line.

8. The blade as defined in claim 7, wherein the additional passageways having their outlet in the blade tip portion and the additional passageways having their outlet below the lower winglet are angled with about +15 degrees in parallelism with each other.

9. The blade as defined in claim 1, wherein the inner face of an upper of the two winglets is substantially vertically extending.

10. The blade as defined in claim 5, wherein the respective outlet of some of the additional passageways is located on a tip surface of the upper winglet.

* * * * *